United States Patent [19]

Silvestri, Jr.

[11] Patent Number: 4,870,823

[45] Date of Patent: Oct. 3, 1989

[54] LOW LOAD OPERATION OF STEAM TURBINES

[75] Inventor: George J. Silvestri, Jr., Winter Park, Fla.

[73] Assignee: Westinghouse Electric Corp., Pittsburgh, Pa.

[21] Appl. No.: 277,831

[22] Filed: Nov. 30, 1988

[51] Int. Cl.[4] ..... F01K 13/00

[52] U.S. Cl. ..... 60/652; 60/653; 60/676; 60/665; 60/667

[58] Field of Search ..... 60/652, 653, 676, 660, 60/664, 665, 667

[56] References Cited

U.S. PATENT DOCUMENTS 4,297,848 11/1981 Silvestri, Jr. ..... 60/660

4,408,458 10/1983 Torii ..... 60/660

*Primary Examiner*—Allen M. Ostrager

*Attorney, Agent, or Firm*—K. Bach

[57] ABSTRACT

In the operation of a turbine system composed of apparatus (6,12,14,16) for generating steam and a turbine first stage (4) having inlet nozzles connected to be supplied with steam from the steam generating apparatus (6,12,14,16), the steam generating apparatus (6,12,14,16) being composed of a cascade arrangement of a boiler (6) producing steam at a selected pressure which has an assigned lower limit value, a primary superheater section (12), one or more division valves (14) presenting a steam flow passage having a controllable cross-sectional area, and a secondary superheater section (16) connected between the division valves (14) and the inlet nozzles, a method for reducing the output of the system at low load levels comprising: reducing the cross-sectional area of the steam flow passage presented by the division valves (14); and increasing the rate at which heat is supplied to the steam in the secondary superheater section (16) by an amount coordinated with the reduction imparted to the cross-sectional area of the steam flow passage by the reducing step.

4 Claims, 1 Drawing Sheet

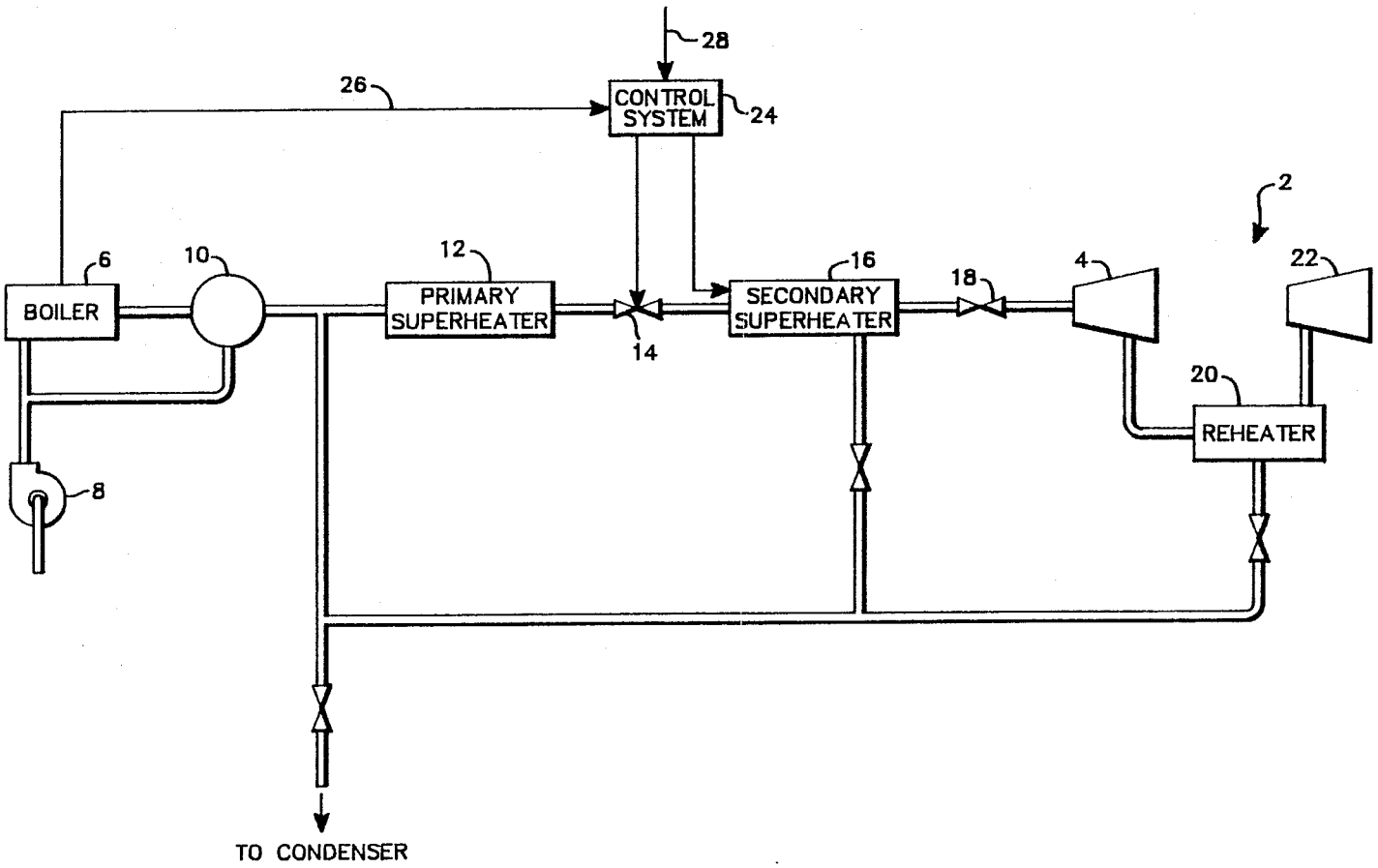
2
22
REHEATER
20
4
18
SECONDARY SUPERHEATER
16
CONTROL SYSTEM
24
28
14
PRIMARY SUPERHEATER
12
26
10
BOILER
6
8
TO CONDENSER

LOW LOAD OPERATION OF STEAM TURBINES

BACKGROUND OF THE INVENTION

The present invention relates to steam turbine control, particularly for operation at low load levels.

During the operation of steam turbines, for example in boiler fired power plants, there is frequently a need to run the turbines at very low load levels, often as low as 5 to 10 percent of rated load, for extended periods of time. Since, however, such installations are designed to operate at rated load, operation at very low load levels entails a decrease in energy utilization efficiency. In addition, known procedures for operating at low load levels give rise to temperature transients which have an adverse effect on plant service life.

Steam turbines employed in power plants include a section containing a first stage to which steam is supplied via a plurality of inlet nozzles distributed around the entire, or a selected portion of the, periphery of the first stage housing. The supply of steam to the first stage can be effected in either one of two ways: full arc admission in which steam is supplied uniformly via all inlet nozzles; and partial arc admission in which the turbine control valves supplying selected inlet nozzles are closed in sequence to effect a progressive reduction in turbine output.

A turbine operating with full arc admission can be run at reduced load by a procedure known as the sliding pressure method in which the speed of the feed pump supplying water to the boiler is reduced. This reduces the pressure throughout the system starting at the pump outlet, through the boiler, the superheaters and, finally, the turbine stages. Reduction in pressure results in a corresponding reduction in the saturation temperature of the steam flowing through these components, so that a temperature transient is experienced by the drum and water walls thereof during each load reduction cycle.

In the case of partial arc turbines, turbine output is reduced first by sequentially closing selected turbine control valves. During this phase, normal pressure and temperature conditions are maintained throughout the system, although the quantity of steam being delivered to the turbine first stage is reduced.

This procedure is most efficient until a point is reached at which the quantity of steam being supplied to the first stage decreases to a certain proportion, in many systems when half of the control valves are fully open and half of the control valves are fully closed. It is more efficient to respond to further load reductions according to the sliding pressure method, as described above.

In the case of each of the procedures described above, reducing the boiler pressure imposes certain temperature stresses on the boiler, particularly since the steam saturation temperature decreases with pressure. Therefore, there has developed the practice of setting a lower limit value on boiler pressure. Once the lower limit value has been reached, further load reductions are handled by throttling, i.e., reducing the flow through, the open turbine control valves. Throttling creates certain disadvantages because it results in cooling of the steam due to the Joule-Thompson effect. This causes temperature transients to occur at the valve bodies and in the turbine. In addition, the steam experiences a loss of available energy which reduces the overall efficiency of the system.

SUMMARY OF THE INVENTION

It is an object of the present invention to operate such a system at very low load levels while avoiding the disadvantages noted above.

A more specific object of the invention is to operate such a system at very low load levels without decreasing the boiler pressure below a selected lower limit value and without throttling the turbine control valves.

A further specific object of the invention is to operate such a system at very low load levels without significantly reducing the temperature of the steam entering the turbine first stage.

The above and other objects are achieved, according to the present invention, in the operation of a turbine system composed of means for generating steam and a turbine first stage having inlet nozzles connected to be supplied with steam from the steam generating means, the steam generating means being composed of a cascade arrangement of a boiler producing steam at a selected pressure which has an assigned lower limit value, a primary superheater, division valve means presenting a steam flow passage having a controllable cross-sectional area, and secondary superheater means connected between the division valve means and the inlet nozzles, by a method for reducing the output of the system at low load levels, which method includes: reducing the cross-sectional area of the steam flow passage presented by the division valve means; and increasing the rate at which heat is supplied to the steam in the secondary superheater means by an amount coordinated with the reduction imparted to the cross-sectional area of the steam flow passage by the reducing step.

The invention is applicable to turbine control systems which include two or more superheater sections and which operate with partial arc or full arc admission, although the invention produces greater operating improvements in partial arc admission systems.

Reduction of turbine output from full load is effected in the manner normally employed in the art, as described earlier herein, until a predetermined lower boiler pressure limit is reached. Once the boiler pressure has decreased to its predetermined lower limit, further reductions in turbine output are achieved, according to the invention, by maintaining the boiler pressure constant and progressively throttling the division valves while varying, in a coordinated manner, the heat energy being supplied to the system in the superheater or superheaters downstream of the division valves. Ideally, the supply of heat energy to the steam is controlled such that the steam arriving at the turbine control valves has a temperature equal to or greater than that which it has when the boiler output pressure is at its lower limit value and the division valves are fully open.

However, as the division valves are progressively throttled, the pressure and mass flow of steam through the open turbine valve or valves decreases, which means that the driving energy delivered to the turbine decreases.

Since the open turbine control valves are not throttled, the steam experiences only minimal pressure and temperature drop while flowing therethrough and thus reaches the turbine first stage at a temperature comparable to that existing at higher load levels.

BRIEF DESCRIPTION OF THE DRAWING

The sole FIGURE is a schematic diagram of a turbine system constructed to operate according to the present invention.

DESCRIPTION OF THE PREFERRED EMBODIMENTS

The FIGURE illustrates what is basically a conventional system for supplying steam to a turbine 2 having a high pressure section 4 containing a plurality of stages including a first stage to which the steam is initially supplied. Steam is produced in a boiler 6 which is supplied with water, as needed, by a pump 8. Steam generated by boiler 6 flows through a distributor 10 which conducts a required portion of the steam to a primary superheater section 12 and returns the remaining steam to the boiler inlet.

In primary superheater section 12, additional heat is added to the steam and the resulting superheated steam is conducted via division valves 14 to a secondary, or finishing, superheater section 16 which brings the steam to the temperature required by the first stage of section 4. This steam is delivered to the first stage of section 4 via turbine control valves 18 which are controlled in a known manner, as described earlier herein.

After flowing through section 4, the steam is conducted through a reheater 20, if provided, to the turbine second section 22. Depending on the particular type of boiler system employed, the inlet to primary superheater section 12, the outlet end of secondary superheater section 16 and reheater 20 may be connected to a condenser, via appropriate valves.

The structure described thus far, and its normal operation, are already known in the art.

According to the invention, division valves 14 and secondary superheater section 16 are connected to be controlled by a control system 24 which additionally receives information relating to the boiler output pressure via a signal line 26 and information relating to the desired output of turbine 2 via a signal line 28.

Boiler 6 is separately controlled in a manner known in the art to produce an output pressure which decreases as the turbine output is to be reduced. When the output pressure from boiler 6 reaches its lower limit value, which is indicated by the pressure signal on line 26, control system 24 is placed into operation under control of the desired boiler output level signal supplied via line 28. On the basis of the value of the latter signal, control system 24 operates to progressively throttle division valves 14 while correspondingly increasing the supply of heat energy to secondary superheater section 16. Control system 24 can be a relatively simple device which is programmed or otherwise set to produce control signals which are a direct function of the turbine load signal supplied via line 28. The precise nature of the relationship between input and output signals will be determined, of course, as a function of the operating parameters of the particular turbine system being controlled.

As division valves 14 are progressively throttled, the rate of flow of steam therethrough, and the temperature of that steam, decreases. However, by increasing the heat energy supplied by secondary superheater section 16, the temperature of the steam can be returned to approximately the value which it would have if division valves 14 were fully open.

Since the steam entering secondary superheater section 16 is at a reduced temperature, heat transfer rates through secondary superheater section 16 can be increased without any danger of burning out the secondary superheater tubes or causing an increase in the steaming rate. Since the temperature of the steam reaching turbine control valves 18 can be made equal to, or possibly even greater than, that existing when division valves 14 are fully open, the result will be an increase in the service life of the turbine control valve bodies.

Moreover, the increase in the firing rate within secondary superheater section 16 results in an increase in energy utilization efficiency.

Furthermore, the throttling effected by division valves 14 acts to increase the velocity of the steam passing through secondary superheater section 16. This assists in increasing the heat transfer rate within secondary superheater section 16 and leads to a better "scrubbing" of the secondary surfaces thereof. Therefore, the useful life of the tubes conducting steam within secondary superheater section 16 will be prolonged.

According to a modified version of the present invention, control system 24 could be responsive to the pressure within the exit chamber of the first stage of section 4, in place of the boiler pressure.

Computer simulations have revealed that the use of the present invention at low load levels results in a significant increase in turbine output and a decrease in overall heat rate compared to operation according to the known methods described earlier herein.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. In the operation of a turbine system composed of means for generating steam and a turbine first stage having inlet nozzles connected to be supplied with steam from the steam generating means, the steam generating means being composed of a cascade arrangement of a boiler producing steam at a selected pressure which has an assigned lower limit value, primary superheater means, division valve means presenting a steam flow passage having a controllable cross-sectional area, and secondary superheater means connected between the division valve means and the inlet nozzles, a method for reducing the output of the system at low load levels comprising: reducing the cross-sectional area of the steam flow passage presented by said division valve means; and increasing the rate at which heat is supplied to the steam in said secondary superheater means by an amount coordinated with the reduction imparted to the cross-sectional area of the steam flow passage by said reducing step.

2. A method as defined in claim 1 wherein said steps of reducing and increasing are carried out while the boiler steam pressure is maintained at the assigned lower limit value.

3. In a turbine system composed of means for generating steam and a turbine first stage having inlet nozzles connected to be supplied with steam from the steam generating means, the steam generating means being composed of a cascade arrangement of a boiler producing steam at a selected pressure which has an assigned lower limit value, primary superheater means, division valve means presenting a steam flow passage having a controllable cross-sectional area, and secondary superheater means connected between the division valve means and the inlet nozzles, the improvement comprising control means for reducing the output of said system at low load levels, said control means being coupled to said division valve means for reducing the cross-sectional area of the steam flow passage presented by said division valve means and to said secondary superheater means for increasing the rate at which heat is suppied to the steam in said secondary superheater means by an amount coordinated with the reduction imparted to the cross-sectional area of the steam flow passage presented by said division valve means.

4. A system as defined in claim 3 wherein said control means are connected to said boiler to receive an input signal representative of the steam pressure in said boiler and are connected to receive a further input signal representative of the desired output of said system.

* * * * *